United States Patent [19]

Ma

[11] Patent Number: 4,919,422

[45] Date of Patent: Apr. 24, 1990

[54] CURVE BALL

[75] Inventor: Hansan Ma, Cape Elizabeth, Me.

[73] Assignee: Tonka Corporation, Minnetonka, Minn.

[21] Appl. No.: 376,317

[22] Filed: Jul. 6, 1989

[51] Int. Cl.[5] ..... A63B 37/14

[52] U.S. Cl. ..... 273/26 R; 273/58 K; 273/65 EG; 273/60 B; 273/DIG. 8; 273/DIG. 20

[58] Field of Search ..... 273/68 K, 65 EG, 65 E, 273/65 EC, 65 ED, 65 EE, 65 EF, 58 B, 58 BA, 58 R, DIG. 8, DIG. 20, 60 R, 60 A, 60 B, 26 R; D21/204; 428/11

[56] References Cited

U.S. PATENT DOCUMENTS

| | | | |
|---|---|---|---|
| D. 294,844 | 3/1988 | Winter | D21/204 |
| 1,150,761 | 8/1915 | Hartman | 273/58 K |
| 1,873,221 | 8/1932 | Senn | 273/60 R |
| 2,280,314 | 4/1942 | Scudder | 273/65 EG |
| 2,521,703 | 9/1950 | Emmitt | 273/58 K |
| 2,776,139 | 1/1957 | Blamey, Jr. et al. | 273/60 B |
| 3,099,450 | 7/1963 | Randall | 273/428 |
| 3,418,000 | 12/1968 | Randall | 273/424 |
| 3,604,352 | 9/1971 | Bench | 102/4 |
| 3,917,271 | 11/1975 | Lemelson et al. | 273/58 K |
| 3,930,650 | 1/1967 | Watson | 273/58 J |
| 4,003,573 | 1/1977 | Craig, Jr. | 273/58 K |
| 4,128,238 | 12/1978 | Newcomb et al. | 273/26 R |
| 4,184,682 | 1/1980 | Collins et al. | 273/58 K |
| 4,286,783 | 9/1981 | Newcomb et al. | 273/26 R |
| 4,616,828 | 10/1986 | Haythornthwaite | 273/58 K |
| 4,772,020 | 9/1988 | Martin | 273/65 EE |

*Primary Examiner*—George J. Marlo
*Attorney, Agent, or Firm*—Fish & Richardson

[57] ABSTRACT

A ball for throwing having a generally spherical shape and balance has an axis, first and second convex surfaces defined about the axis at opposite poles, and at least one groove having a non-uniform depth defined in the surface of the ball between the first and second convex surfaces. The groove is arranged to extend through the equatorial region of the ball, between the first and second convex surfaces.

13 Claims, 3 Drawing Sheets

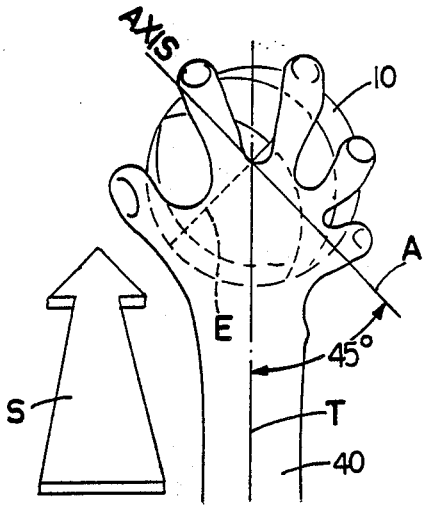
Fig.8
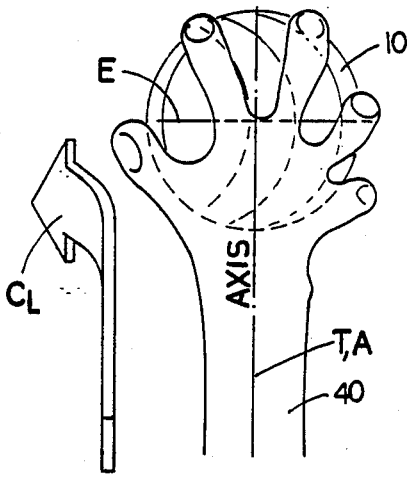
Fig.9
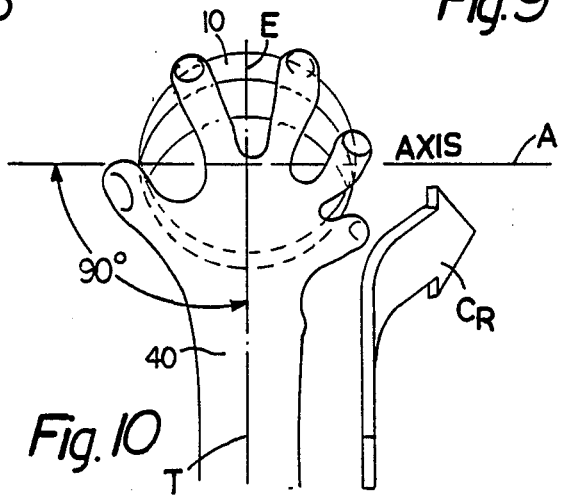
Fig.10
Fig.11
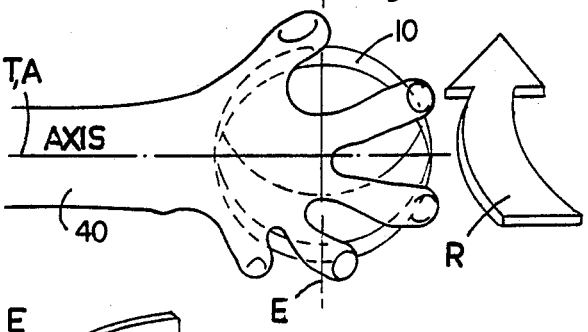
Fig.12
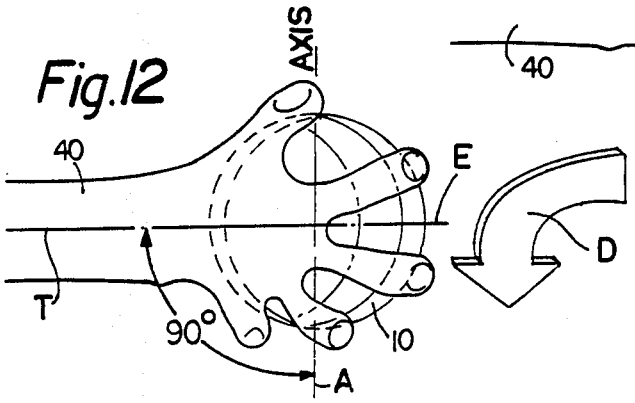

CURVE BALL

The invention relates to generally spherical projectiles for throwing.

Experienced athletes, e.g. professional baseball pitchers and others, through practice, have the ability to cause a thrown spherical ball to vary, or curve, during flight in a controlled manner by means of grip and spin imparted to the ball. Others have sought to vary ball construction to enable less skilled athletes, and even children, to cause the same movement of the ball in flight. For example, Senn U.S. 1,873,221 describes a baseball having its center of gravity offset from the true center of the ball. Blamey, Jr. et al. U.S. Pat. No. 2,776,139 describes a spherical hollow game ball with apertures extending over only a portion of the ball surface, the remainder of the surface being imperforate. Randall, in U.S. Pat. No. 3,099,450, describes a game projectile having a convex surface and a flat undersurface, but in a later patent (U.S. Pat. No. 3,416,800) suggests a concave undersurface to cause the projectile to turn more sharply right and left. Watson U.S. Pat. No. 3,930,650 describes a throwing device with generally hemispherical shape with a rounded base. Newcomb et al. U.S. Pat. No. 4,128,238 and 4,286,783 describe a practice baseball constructed with a flat area resulting from removal of a small segment of the sphere in order that the ball will curve even when thrown in a manner that would cause a conventional baseball to travel straight.

SUMMARY OF THE INVENTION

According to the invention, a ball for throwing having generally spherical shape and balance has an axis, a first convex surface defined about the axis, an opposite, second convex surface defined about the axis, and at least one groove defined in the surface of the ball between the first and second convex surfaces, the groove arranged to extend through the equatorial region of the ball, between the first and second convex surfaces.

Preferred embodiments may include one or more of the following features. The groove extends arcuately between first and second convex surfaces. Each convex surface defines a perimeter and the ends of the groove lie generally tangent to the perimeters. The groove comprises a first groove surface and a second groove surface, the first groove surface, in the region of the ball equator, is disposed generally normal to the projected spherical surface of the ball, and the second groove surface, in the region of the ball equator, is disposed generally tangent to the projected spherical surface of the ball. Preferably the first and second groove surfaces intersect at a radius surface. Also, adjacent groove surfaces of adjacent grooves intersect, preferably at an angle of intersection of the order of about 90 degrees. The ball is comprised of polyurethane foam with a thin coating of plastic.

According to another aspect of the invention, a ball for throwing having a generally spherical shape and balance has an axis, a first convex surface defined about the axis, an opposite, second convex surface defined about the axis, and means for causing the ball, when gripped and thrown in a predetermined manner, to consistently travel on a preselected course, the means comprising at least one groove defined in the surface of the ball between first convex surface and second convex surface.

Preferred embodiments of this aspect of the invention may include one or more of the following features. The ball, when gripped with the axis at 45 degrees to the axis of a thrower's arm and thrown with an overhand motion, is caused to travel a straight course. The ball, when gripped with the axis aligned with the axis of a thrower's arm and thrown with an overhand motion, is caused to travel in a left curve. The ball, when gripped with the axis at 90 degrees to the axis of a thrower's arm and thrown with an overhand motion, is caused to travel in a right curve. The ball, when gripped with the axis aligned with the axis of a thrower's arm and thrown with a sidearm motion, is caused to travel in an upward curve (riser). The ball, when gripped with the axis at 90 degrees to the axis of a thrower's arm and thrown with a sidearm motion, the ball is caused to travel in a downward curve (drop).

Thus there is provided according to the invention a generally spherical ball that, when thrown in a conventional manner, is caused to curve left or right, rise or fall, or travel straight, depending on the orientation of the ball in the thrower's hand, and the throwing motion (overhand or side arm) employed.

These and other features and advantages will be seen from the following description of a presently preferred embodiment, and from the claims.

PREFERRED EMBODIMENT

We first briefly describe the drawings.

Figure 1:
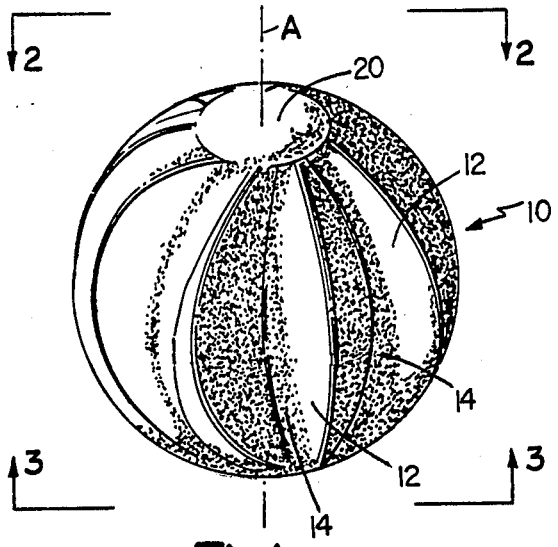
FIG. 1 is a perspective view of a curve ball of the invention.
Figure 2:
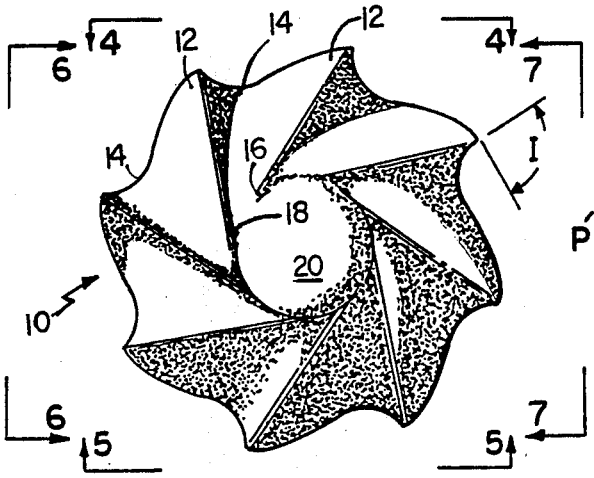
FIG. 2 is a top view of the curve ball taken at the line 2—2 of FIG. 1.
Figure 3:
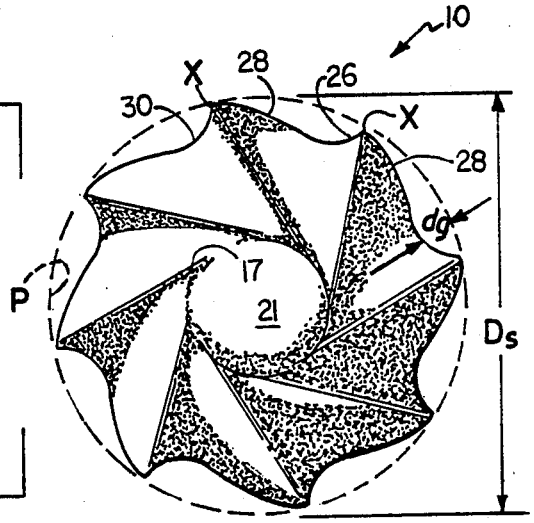
FIG. 3 is a bottom view taken at the line 3—3 of FIG. 2.
Figure 4:
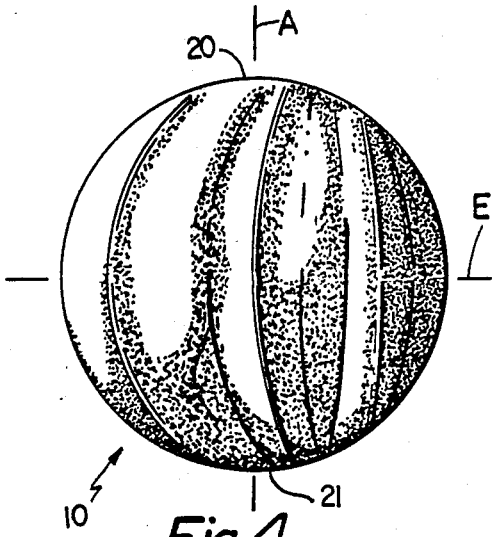
Figure 5:
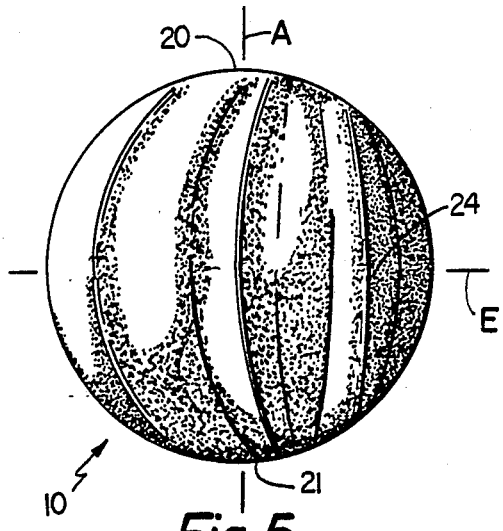
Figure 6:
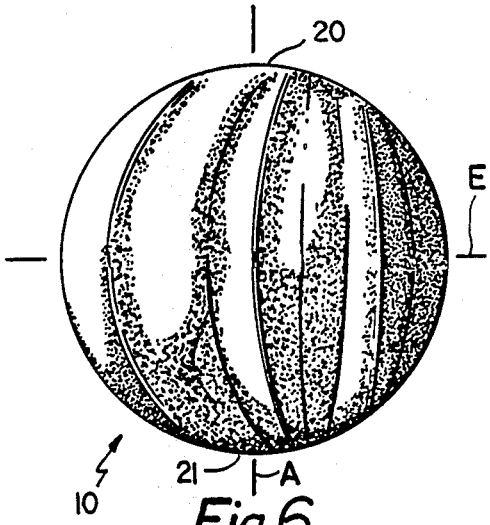
Figure 7:
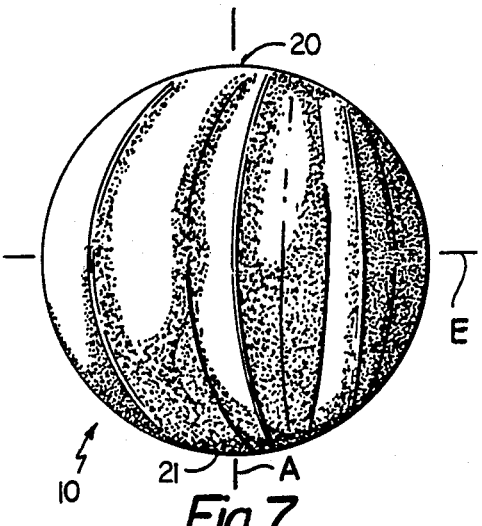

FIGS. 4 and 5 are front and rear views taken at the lines 4—4 and 5—5, respectively, of FIG. 2, while FIGS. 6 and 7 are side views taken at the lines 6—6 and 7—7 respectively of FIG. 2.

FIGS. 8, 9, and 10 are diagrammatic representations showing use of the curve ball of the invention for overhand throws; and FIGS. 11 and 12 are similar views showing use of the curve ball of the invention for side arm throws.

Referring to FIGS. 1 through 7 a curve ball 10 of the invention is formed of polyurethane foam with a thin plastic coating (i.e., a NERF®-like construction). Viewed from above (FIG. 2), the surface of the ball has, about its circumference, a series of fins 12, e.g. eight are shown for a ball diameter, $D_s$, about 3½ inches, formed by arcuate grooves 14 in the surface of the ball. The ends 16, 17 of each groove lie tangent to the perimeters 18 of opposite convex surfaces 20, 21 disposed about the axis A of the ball 14 at each pole of the sphere. Each groove 14, between its groove ends 16, 17, extends across the equator E of the sphere, each groove having a maximum depth at the sphere equator, dg, e.g. about ⅜ inch. Each groove 14 is defined by first and second, generally arcuate, groove surfaces 26, 28. The adjacent surfaces of adjacent grooves intersect at an angle I, e.g., of about 90°, with the first groove surface 26 disposed generally normal to a projection of the sphere surface P and the second groove surface 28 generally tangent to the sphere surfaces P at the point of intersection X. The adjacent surfaces intersect within the grooves at radius surface 30.

The ball has a spherical shape without deviation from the balance. It is soft, safe and pleasing to the look and feel. It is easy to catch without using a glove, and it is strong enough to be hit with a bat.

The natural motions of a person throwing an object forward are overhand (FIGS. 8 to 10) and sidearm (FIGS. 11, 12). Both motions cause the object being tossed to have a natural backspin motion, imparted when the fingers of the thrower snap across the ball at the last moment of release.

Referring now to FIG. 8, in order to cause the ball 10 of the invention to travel straight (arrow S), the ball is gripped with the axis A at 45 degrees to the axis T of the thrower's arm 40, and the ball is thrown with an overhand motion. To cause the ball to curve left (arrow $C_L$, FIG. 9), the ball is gripped with the ball axis A generally aligned with the axis T of the thrower's arm and again the ball is thrown with an overhand motion. In order to throw a curve ball to the right (arrow $C_R$, FIG. 10), the ball is gripped with the axis A at 90 degrees to axis T of the thrower's arm, and the ball is thrown with an overhand motion.

To cause the ball 10 to rise or sink, the ball is thrown with a sidearm motion (FIGS. 11, 12). Referring to FIG. 11, for a rising (curve up) path of travel (arrow R), the ball is gripped with the ball axis A aligned with axis T of the thrower's arm. Referring to FIG. 12, for a sinking (curve down) path of travel (arrow D), the ball is gripped with the ball axis A at 90 degrees to the axis T of the thrower's arm.

The design and construction of the curve ball of the invention allows a player to pitch a consistent curved ball with simple and easy to follow instructions. It also provides unlimited potential for a pitcher to practice to achieve different flight paths by varying the speed, spin and pitching angle.

Other embodiments of the invention are within the following claims.

What is claimed is:

1. A ball for throwing in different flight paths having a generally spherical shape and balance, the ball having an axis, a first relatively smooth convex surface defined about said axis, an opposite, second relatively smooth convex surface defined about said axis, and at least one groove having a non-uniform depth defined in the surface of the ball and extending continuously from said first convex surface to said second convex surface, and through the equatorial region of said ball, said groove being spanned by peaks, the termini of which, with said convex surfaces define the generally spherical shape of the ball.

2. The ball of claim 1 wherein said groove extends arcuately between said first and second convex surfaces.

3. The ball of claim 1 wherein each said convex surface defines a perimeter and the ends of said groove lie generally tangent to said perimeters.

4. The ball of claim 1 wherein said groove comprises a first groove surface and a second groove surface, said first groove surface, in the region of the ball equator, disposed generally normal to the projected spherical surface of the ball, and said second groove surface, in the region of the ball equator, disposed generally tangent to the projected spherical surface of the ball.

5. The ball of claim 4 wherein said first and second groove surfaces intersect at a radius surface.

6. The ball of claim 4 wherein said ball includes a plurality of grooves, with adjacent groove surfaces of adjacent grooves in intersection.

7. The ball of claim 6 wherein the angle of intersection is of the order of about 90 degrees.

8. The ball of claim 1 comprised of polyurethane foam with a thin coating of plastic.

9. The ball of claim 1 wherein, with said ball gripped with said axis at 45 degrees to the axis of a thrower's arm and thrown with an overhand motion, said ball is caused to travel a straight course.

10. The ball of claim 1 wherein, with said ball gripped with said axis aligned with the axis of a thrower's arm and thrown with an overhand motion, said ball is caused to travel in a left curve.

11. The ball of claim 1 wherein, with said ball gripped with said axis at 90 degrees to the axis of a thrower's arm and thrown with an overhand motion, said ball is caused to travel in a right curve.

12. The ball of claim 1 wherein, with said ball gripped with said axis aligned with the axis of a thrower's arm and thrown with a sidearm motion, said ball is caused to travel in an upward curve (riser).

13. The ball of claim 1 wherein, with said ball gripped with said axis at 90 degrees to the axis of a thrower's arm and thrown with a sidearm motion, said ball is caused to travel in a downward curve (drop).

* * * * *